US005661266A

United States Patent [19]

Chang

[11] Patent Number: 5,661,266

[45] Date of Patent: Aug. 26, 1997

[54] ENGINE IGNITION CABLE STRUCTURE

[76] Inventor: Po-Wen Chang, No.68, Lane 300, Pateh Road, Sec.2, Taipei, Taiwan

[21] Appl. No.: 431,143

[22] Filed: Apr. 28, 1995

[51] Int. Cl.[6] ..... H01B 7/18; H01B 9/02

[52] U.S. Cl. ..... 174/102 SC; 174/120 SC; 338/214

[58] Field of Search ..... 174/120 SC, 120 R, 174/120 SR, 120 AR, 102 SC, 110 N, 110 AR, 110 SR, 110 PM, 118; 338/214

[56] References Cited

U.S. PATENT DOCUMENTS

| | | | |
|---|---|---|---|
| 4,435,692 | 3/1984 | Miyamoto et al. | 174/120 SC |
| 4,689,601 | 8/1987 | Coffey et al. | 174/120 SC |
| 4,700,171 | 10/1987 | Coffey et al. | 174/120 SC |
| 4,970,488 | 11/1990 | Horiike et al. | 174/120 SC |
| 5,034,719 | 7/1991 | Brown et al. | 174/102 SC |
| 5,057,812 | 10/1991 | Yukawa et al. | 174/120 R |

*Primary Examiner*—Kristine L. Kincaid
*Assistant Examiner*—Marc D. Machtinger
*Attorney, Agent, or Firm*—Ostrolenk, Faber, Gerb & Soffen, LLP

[57] ABSTRACT

An engine ignition cable includes a stretching resistant central core over which an intermediate layer made of a mixture of silicone with ferric oxide powders with a ratio of 4:1 is fit. A high conductivity wire is then wrapped around the intermediate layer, preferably in a helix form, to provide a low impedance current path having an impedance of 0.8 kΩ per meter length. An insulation outer layer or sheath which may be made of silicone or rubber, is then used to enclose the cable. The use of the high conductivity wire causes a strong electro-magnetic radiation when in operation which can be counteracted, at least partially, by the magnetic field established by the intermediate layer that consists of ferric oxide powders.

2 Claims, 4 Drawing Sheets

ENGINE IGNITION CABLE STRUCTURE

FIELD OF THE INVENTION

The present invention relates to an engine ignition cable and in particular to an engine ignition cable that employs a high conductivity wire to reduce overall impedance of the ignition cable and incorporates ferric oxide powders in an intermediate layer of the ignition cable to counteract and thus reduces the increased magnetic field resulted from current flowing through the high conductivity wire.

BACKGROUND OF THE INVENTION

Engines, particularly gasoline engines, use a distributor to distribute high voltage electricity to cylinders, or more specifically spark plugs associated with the cylinders, for ignition. The transmission of high voltage electricity from the distributor to the cylinders or the spark plugs is done via high voltage cables, which are usually called ignition cables or ignition wires. A conventional ignition cable is shown in FIG. 4, which usually comprises an outer insulation sheath 92 generally made of rubber of silicone material in which a stretching resistant central core 94, usually made of a bundle of fiber material to provide resistance to stretching. A conductive intermediate layer 96, which is a mixture of graphite and rubber, is interposed between the outer sheath 92 and the central core 94 to transmit the high voltage electricity for ignition.

A problem associated with conventional ignition cable of this kind is that it possess a very high impedance, for example 16 kΩ±20% per meter length as indicated in JIS code C3409. The cables that connect to different cylinders of an engine usually have different lengths which results in a great difference in the overall cable impedance for different cylinders. For example, assuming the first cylinder of an engine takes an ignition cable of one meter long and that of the fourth cylinder half meter long, the difference in overall impedance between these two cylinders may be as high as 8 kΩ per meter length, if taking the value of JIS code C3409. Such a great difference in impedance may lead to a non-uniform power output of the engine.

To solve such a problem, attempts have been made to decrease the impedance per unit length of the ignition cable. However, the decrease of the impedance leads to increase in electro-magnetic radiation which causes interference with the operations of computer-based control system and radio.

Further, the conventional ignition cable structure mentioned above also has an aging problem after one or two years service. As a consequence of aging, ignition may become poor and thus the ignition cables have to be replaced for maintaining proper operation and efficiency of the engine.

It is therefore desirable to provide an engine ignition cable which is capable to overcome both the impedance and electro-magnetic radiation problems of the prior art structure.

SUMMARY OF THE INVENTION

The principal object of the present invention is therefore to provide an improved engine ignition cable structure which employs a high conductivity wire, having an impedance of for example 0.8 kΩ per meter length which is much smaller than JIS code C3409, for transmitting high voltage electricity from the distributor to the spark plug and also incorporates an intermediate layer that is a mixture of silicone with ferric oxide powders, which intermediate layer being magnetized in advance to establish a permanent magnetic field for counteracting the electro-magnetic radiation generated by electricity through the high conductivity wire.

In accordance with the present invention, an improved engine ignition cable is provided, comprising a stretching resistant central core over which an intermediate layer made of a mixture of silicone with ferric oxide powders with a ratio of 4:1 is fit. A high conductivity wire is then wrapped around the intermediate layer, preferably in a helix form, to provide a low impedance current path having an impedance of 0.8 kΩ per meter length. An insulation outer layer or sheath which may be made of silicone or rubber, is then used to enclose the cable. The use of the high conductivity wire causes a strong electro-magnetic radiation when in operation which can be counteracted, at least partially, by the magnetic field established by the intermediate layer that consists of ferric oxide powders.

BRIEF DESCRIPTION OF THE DRAWINGS

The present invention will be better understood from the following description of a preferred embodiment thereof, with reference to the attached drawings, wherein.

DETAILED DESCRIPTION OF THE PREFERRED EMBODIMENT

Figure 1:
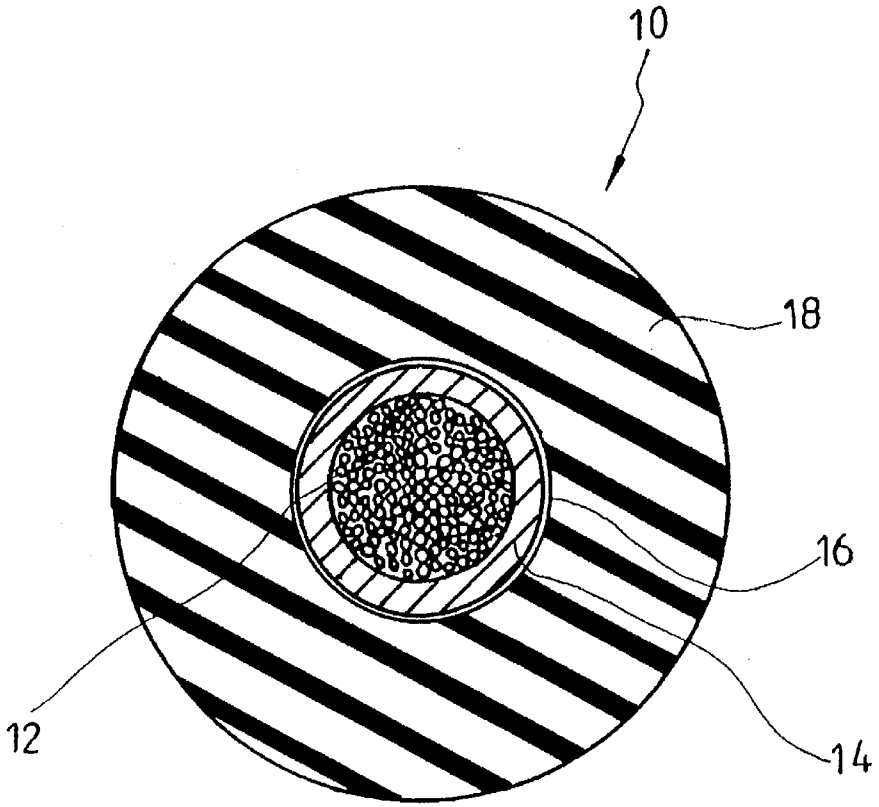
FIG. 1 is a cross-sectional view showing an engine ignition cable constructed in accordance with the present invention.
Figure 2:
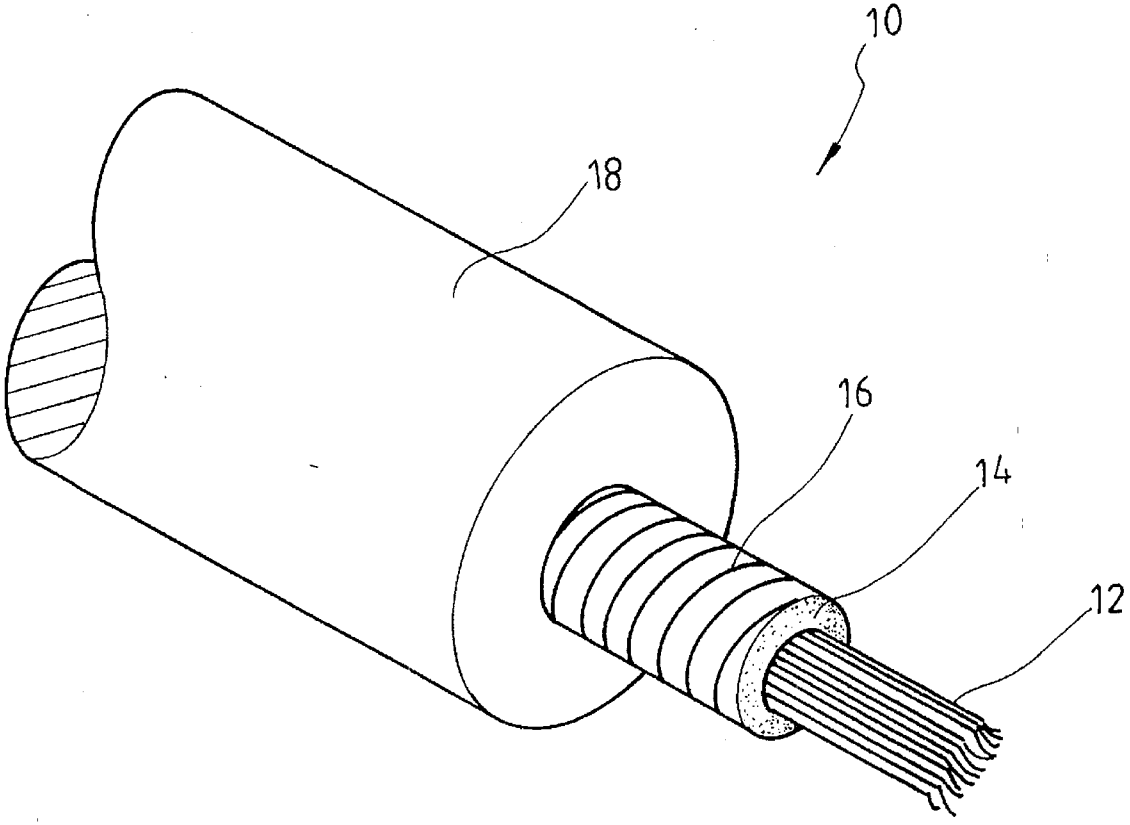
FIG. 2 is a perspective view, partially cut away, showing the engine ignition cable constructed in accordance with the present invention.
Figure 4:
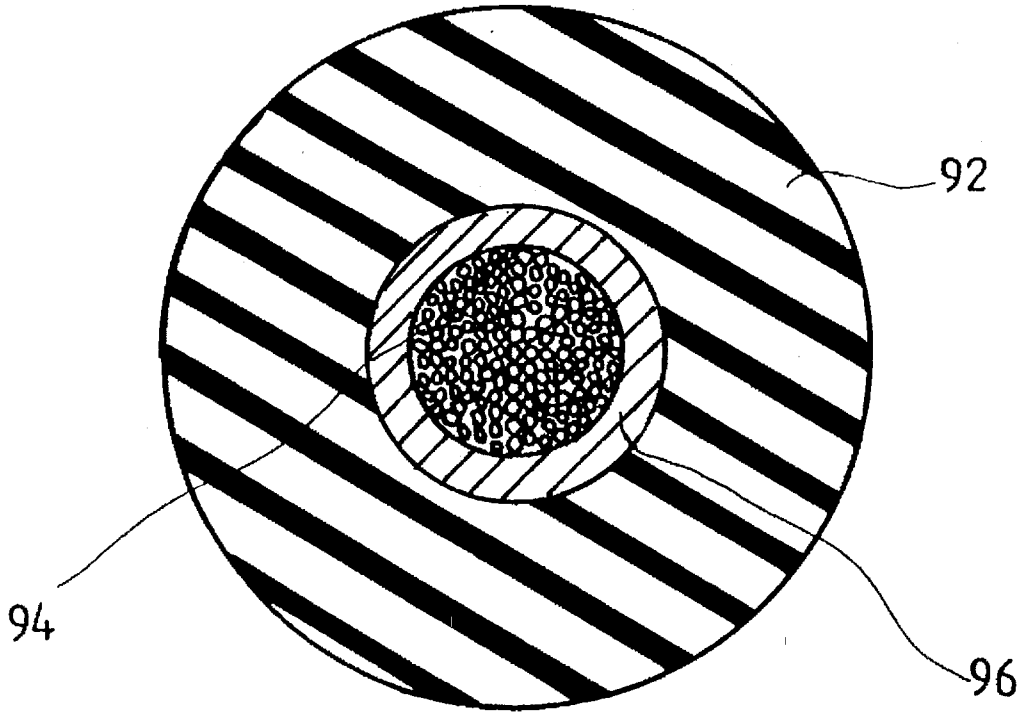
FIG. 4 PRIOR ART
FIG. 4 is a cross-sectional view showing a prior art engine ignition cable structure.

With reference to the drawings and in particular to FIGS. 1 and 2, wherein an engine ignition cable constructed in accordance with the present invention, generally designated with the reference numeral 10, is shown, the engine ignition cable 10 comprises a stretching resistant central core 12 made of a bundle of filaments or fiber material as is conventionally used in the prior art ignition cable shown in FIG. 4, with a tubular intermediate layer 14 fit thereon. The intermediate layer 14 is made of a mixture of silicone material with ferric oxide powders, the ratio of which, in accordance with a preferred embodiment, is 4 unit silicone to 1 unit ferric oxide powder. The intermediate layer 14 that comprises ferric oxide is magnetized to establish a permanent magnetic field.

A high conductivity wire 16 is then wrapped around the intermediate layer 14, preferably in the form of helix as shown in FIG. 2, to provide a low impedance current path. In accordance with a preferred embodiment of the present invention, the impedance of the wire 16 is approximately 0.8 kΩ per meter length, which is much smaller than the standard set in JIS code C3409, and thus the impedance difference between different ignition cables that have different lengths can be significantly reduced.

An outer insulation sheath 18 is then enclosed over the intermediate layer 14 and the wire 16 to complete the ignition cable 10. As is well known, the outer sheath 18 may be made of silicone or rubber materials.

As is discussed above, using the high conductivity wire 16 to transmit high voltage electricity from a distributor (not shown) to a spark plug (not shown) will cause a strong electro-magnetic radiation which may interfere with the operations of for example computer-based control system and radio. In accordance with the present invention, such an electro-magnetic radiation is counteracted, at least partially, by the magnetic field provided by the intermediate layer 14 so as not to cause significant electro-magnetic interference.

The manufacturing of the engine ignition cable of the present invention may comprise the following steps:

(1) forming a tubular member (the intermediate layer 14) with a mixture of silicone with ferric oxide powders and fitting the tubular member 14 over a stretching-resistant central core 12 made of filaments or fiber material;

(2) magnetizing the tubular member 14 to establish a permanent magnetic field;

(3) wrapping a high conductivity wire around the tubular member 14; and (4) then enclosing the cable formed in step (3) with an insulation sheath 18.

Figure 3:
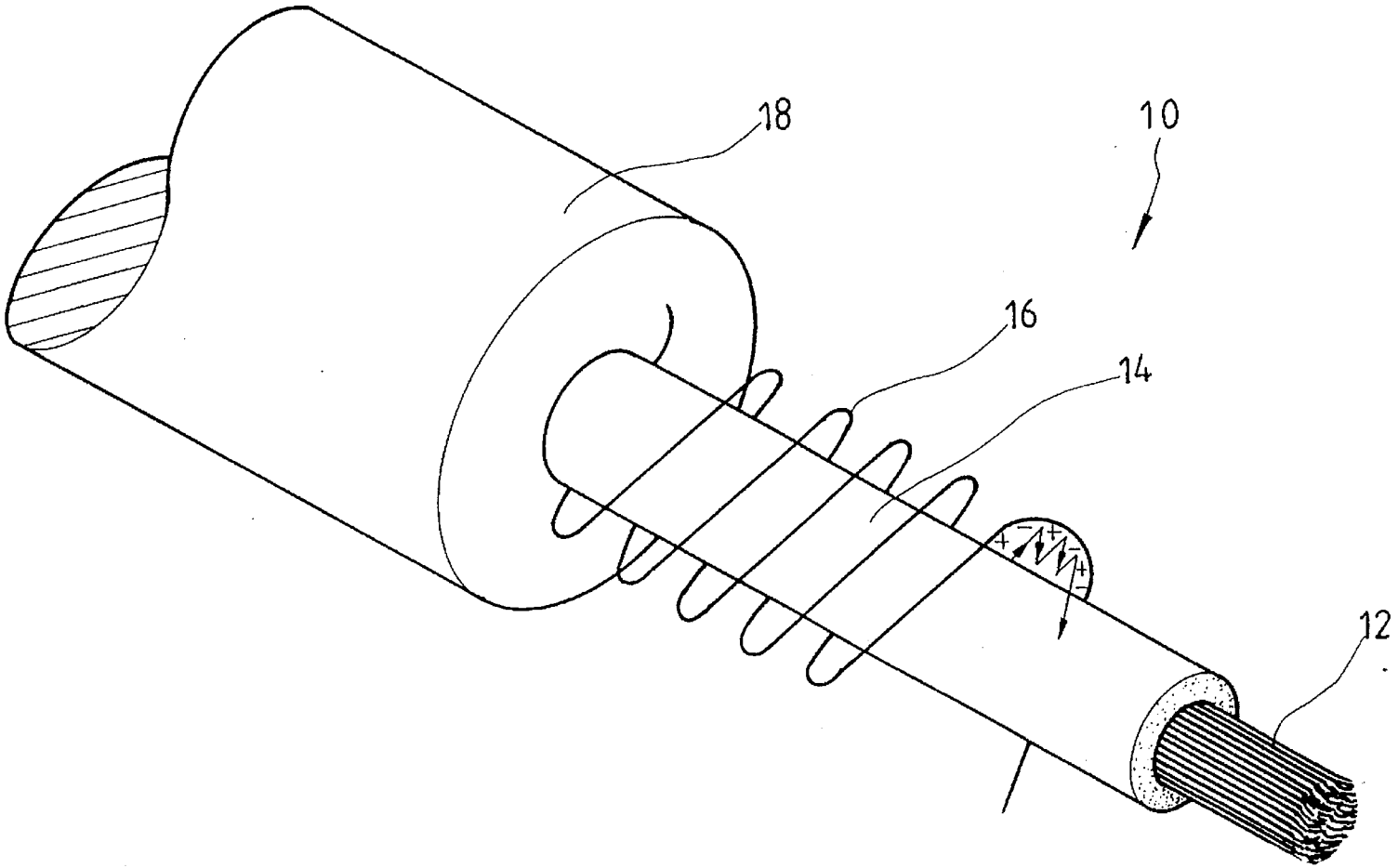
FIG. 3 is a perspective view, partially cut away, schematically showing how the magnetic field provided by the intermediate layer counteracts-the electro-magnetic radiation generated by the high conductivity wire.

FIG. 3 schematically shows the counteraction of the magnetic field provided by the intermediate layer 14 against the electro-magnetic radiation generated by current flowing through the wire 16. Such a counteraction reduces the magnitude of the electro-magnetic radiation of the wire 16 so as to overcome the electro-magnetic interference problem.

Although a preferred embodiment has been described to illustrate the present invention, it is apparent that changes and modifications in the specifically described embodiment can be carried out without departing from the scope of the invention which is intended to be limited only by the appended claims.

What is claimed is:

1. An engine ignition cable comprising:

a stretching resistant central core;

a tubular intermediate layer made of a mixture of silicone with ferric oxide powders of a predetermined ratio fit over the central core, the intermediate layer being magnetized to establish a permanent magnetic field;

a high conductivity wire surrounding the intermediate layer having an impedance of 0.8 kΩ per meter length to provide a low impedance current path; and an insulation outer sheath covering around the intermediate layer and the high conductivity wire.

2. The engine ignition cable as claimed claim 1, wherein the ratio of silicone to ferric oxide powder in the intermediate layer is 4:1.

* * * * *